US005292091A

United States Patent [19]

Callegari et al.

[11] Patent Number: 5,292,091

[45] Date of Patent: Mar. 8, 1994

[54] OPERATING DEVICE FOR RAILWAY SWITCHES, PARTICULARLY FOR HIGH-SPEED LINES

[75] Inventors: Ugo Callegari; Giovanni Gritti, both of Bologna; Maurizio Biagiotti, Pisa; Claudio Siliani, Florence, all of Italy

[73] Assignee: SASIB S.p.A., Bologna, Italy

[21] Appl. No.: 771,359

[22] Filed: Oct. 4, 1991

[30] Foreign Application Priority Data

Oct. 10, 1990 [IT] Italy ..... 12523 A/90

[51] Int. Cl.[5] ..... B61L 7/04; E01B 7/02

[52] U.S. Cl. ..... 246/258; 246/382; 246/448

[58] Field of Search ..... 246/257, 258, 259, 382, 246/385, 387, 415 R, 435 R, 439, 442, 443, 448, 452

[56] References Cited

U.S. PATENT DOCUMENTS

| | | | |
|---|---|---|---|
| 853,857 | 5/1907 | Baxter et al. | 246/452 X |
| 1,273,983 | 7/1918 | Alonzo | 246/382 |
| 1,802,875 | 4/1931 | Conley | 246/415 R |
| 1,976,827 | 10/1934 | Bone | 246/448 X |
| 2,979,295 | 4/1961 | Hewes | 246/435 R |
| 3,099,427 | 7/1963 | Brown | 246/435 R |
| 3,737,658 | 6/1973 | Dohse et al. | 246/442 X |
| 3,745,336 | 7/1973 | Dohse et al. | 246/442 |
| 3,977,635 | 8/1976 | Pirker et al. | 246/415 R X |
| 4,005,839 | 2/1977 | Frank | 246/415 R |
| 4,213,588 | 7/1980 | Bowles | 246/259 |
| 4,428,552 | 1/1984 | Frank et al. | 246/258 X |
| 4,534,527 | 1/1985 | van Eyken et al. | 246/448 X |
| 4,921,189 | 5/1990 | Callegari | 246/448 |

FOREIGN PATENT DOCUMENTS

| | | | |
|---|---|---|---|
| 2529535 | 1/1977 | Fed. Rep. of Germany | 246/439 |
| 2817782 | 10/1979 | Fed. Rep. of Germany | 246/435 R |
| 3511891 | 10/1985 | Fed. Rep. of Germany | 246/448 |
| 3825182 | 2/1990 | Fed. Rep. of Germany | 246/258 |

*Primary Examiner*—Michael S. Huppert
*Assistant Examiner*—Scott L. Lowe
*Attorney, Agent, or Firm*—Larson and Taylor

[57] ABSTRACT

An operating device for railroad switches, particularly for high-speed lines. To permit more stable positioning of the blades (A1,A2) and of the frog (C) of the switch, which in high-speed lines are of considerable length, in addition to the switching actuator (1) at the toes of the blades (A1,A2) and to that (3) of the frog (C), there are distributed along the blades (A1,A2) and along the frog (C) one or more further switching actuators (2,3'). The switching actuators (1,2) of the blades (A1,A2) and the switching actuators (3,3') of the frog (C) are of the hydraulic type and are controlled respectively by a hydraulic control unit (4,4').

22 Claims, 9 Drawing Sheets

OPERATING DEVICE FOR RAILWAY SWITCHES, PARTICULARLY FOR HIGH-SPEED LINES

SUMMARY OF THE INVENTION

The invention relates to an operating device for railway switches, particularly for high-speed lines, comprising an actuator to switch the blades at the toes of the blades and an actuator to switch the frog of the switch, as well as means of controlling the said actuators.

In switches for high-speed lines, the blades of the switches are of considerable length. When a railway train passes, particularly at high speed, the blade in the opened position is subjected to a considerable stress which may cause it to move, with consequent increased wear on the switches or possible fracture of the switching units as a result of fatigue. Moreover, for high-speed lines it is extremely important that the railway line should always have a correct and reliable track geometry.

Such disadvantages cannot be avoided if a single switching actuator, acting either on the toes of the blades or on the frog, is provided, as in known railway switches. Control of the switching actuators performed conventionally with the aid of electromechanical means, for example with a switching box, working through linkages, couplings, and associated transmission units, does not ensure the correct positioning of the blades and of the frog, since these are necessarily of considerable length and are therefore subject to greater longitudinal expansion due to the effects of heat.

The object of the invention is to provide an operating device for railway switches, particularly for high-speed lines, of the type described initially, such that it is capable of effectively avoiding the disadvantages of the known switches, enabling the switches to be set in a relatively rigid way at all times and in such a way as to obtain correct and reliable track geometry.

The invention achieves this object with an operating device for railway switches, particularly for high-speed lines, of the type described initially, in which, in addition to the switching actuator at the toes of the blades there are provided one or more further intermediate switching actuators for the blades, distributed suitably along the length of the blades, the said intermediate switching actuators being located between the switching actuator of the toes of the blades and the frog of the switch.

In the switching operation, the blades, particularly the blade in the opened position, are supported in a very rigid way in their final position, while remaining flexible during switching. In this way any movement of the blades during the passage of a train is prevented, thus reducing wear and the risk of fatigue fracture.

According to a further characteristic, the frog of the switch is also provided with one or more additional switching actuators, distributed suitably along its length.

The control unit and consequently the actuators themselves should preferably be of the hydraulic type. A hydraulic blade actuator control unit and a hydraulic frog actuator control unit may advantageously be provided. A simple switch will therefore have two hydraulic control units. The hydraulic units may be constructed in such a way that one may be used as the reserve of the other by suitable manual operations.

They may be operated either manually or by remote control.

The hydraulic operation of the actuators eliminates the disadvantages associated with the conventional system of linkages, couplings and transmissions, providing a constantly highly precise positioning of the blades and frog in accordance with a geometrically correct railway track layout. The individual switching points corresponding to the individual switching actuators may easily be controlled from a single control unit. Hydraulic operation imparts considerable stability of positioning to the blades and high flexibility of the blades during the switching movement, since the movement of the blades is matched to the increase or decrease of pressure required by the higher or lower friction arising from the drag of the blades.

The hydraulic control units may advantageously be provided with safety devices capable of preventing the operation of the switching device when the available power, or the pressure in the hydraulic circuit, is insufficient to ensure the execution of the complete switching movement (switch from and return to the starting position). By this means, in case of leakage or failure of the control unit or of the actuator supply circuit for example, the switch always remains in its last fixed position, preventing the occurrence of hazardous conditions due to the stoppage of the blades in a non-fixed position of the switch.

To avoid adversely affecting or weakening the packing of the sleepers in the ballast, and consequently to impede the amplification of the vibrations of the rail and sleeper assembly due to the passage of a railway train, the intermediate switching actuators of the blades are located on the sleepers themselves, between the blades of the switch.

The above description demonstrates the advantages of the present invention which provides more precise and stable positioning of the blades and frogs of switches for high-speed lines.

Further characteristics of the present invention form the subject of the subsidiary claims.

BRIEF DESCRIPTION OF THE DRAWINGS

These and other characteristics of the invention, and the advantages derived therefrom, will be shown in greater detail by the following description of an embodiment illustrated in the drawings, in which.

Figure 12:
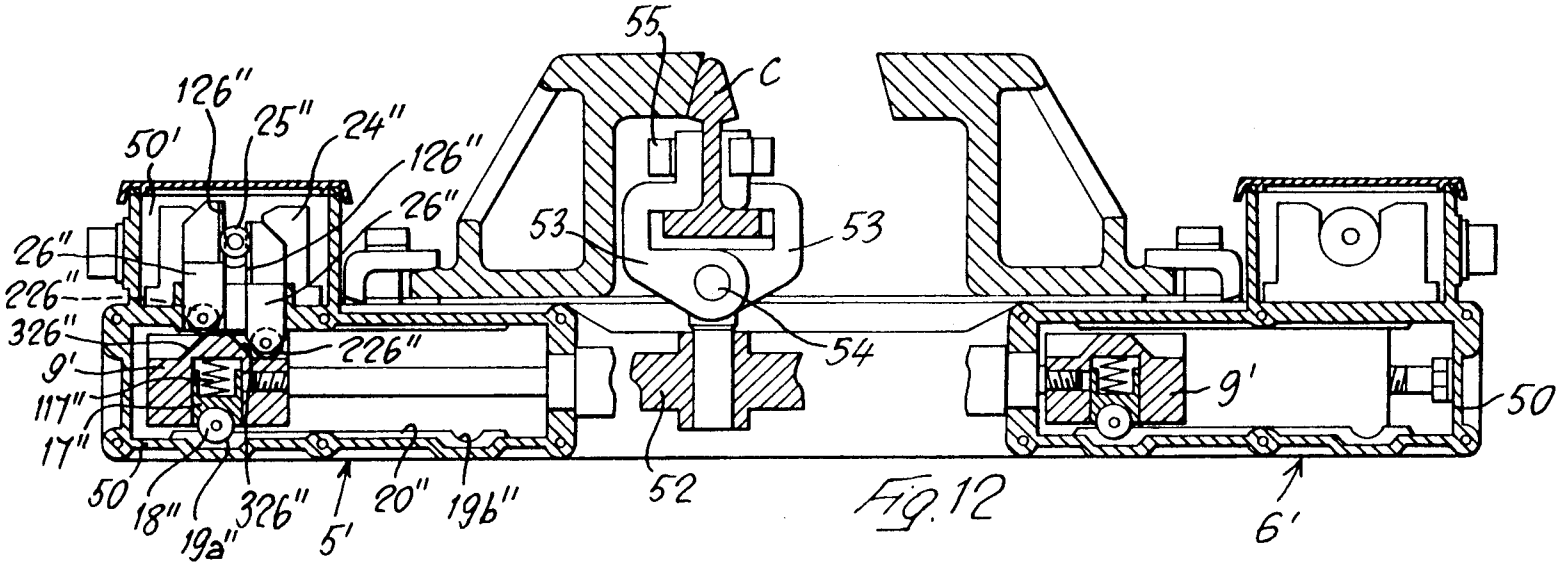
Figure 13:
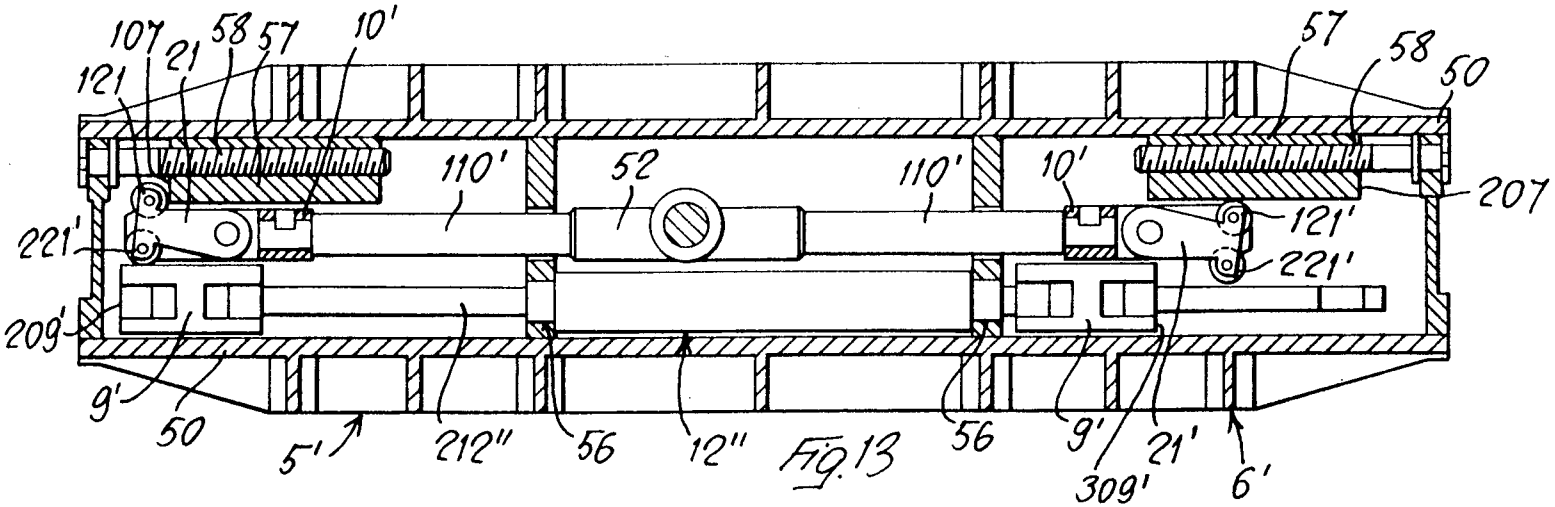
Figure 14:
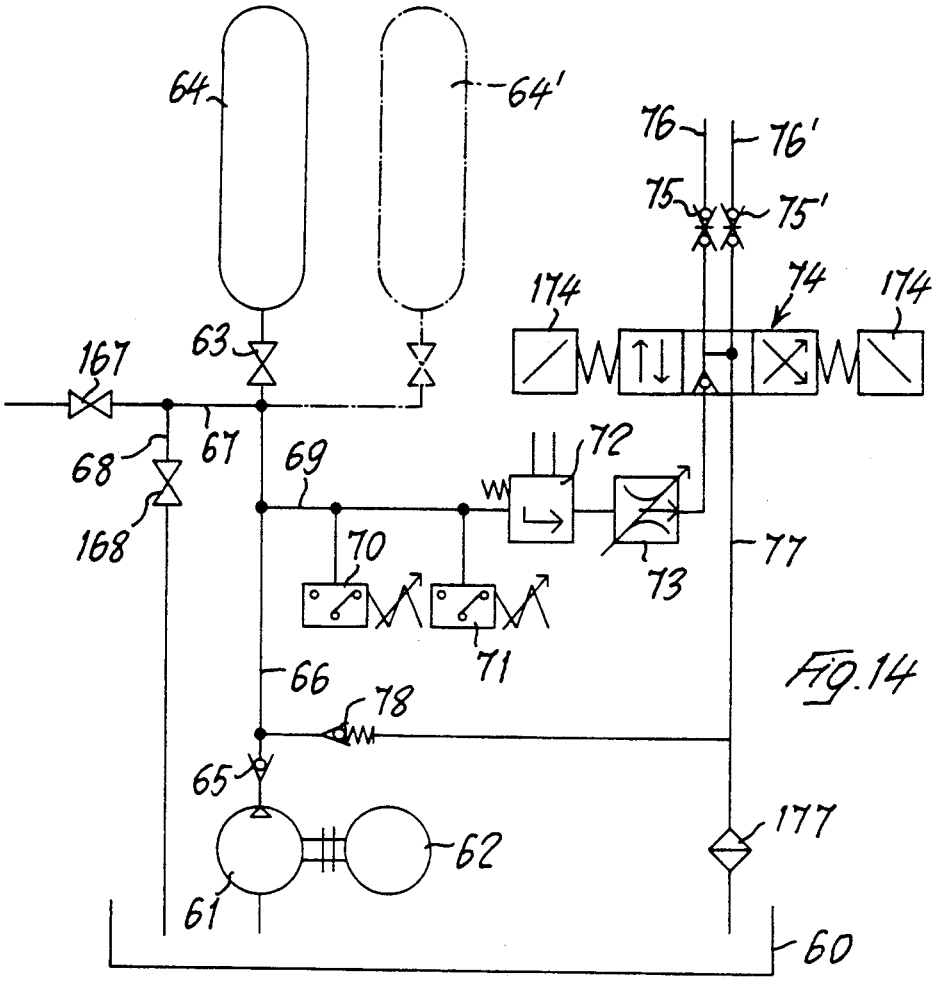
Figure 15:
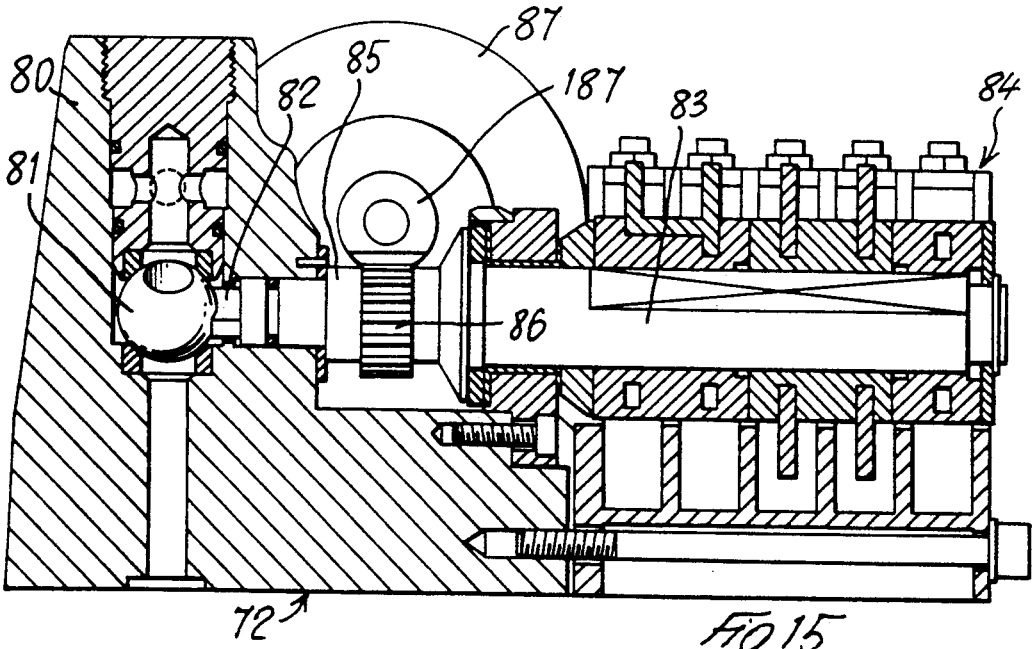

each of FIGS. 12 and 13 is a different sectional view of a switching actuator for the frog of the switch;

FIG. 14 is a block diagram of the control unit for the switching actuators according to the preceding figures;

FIG. 15 is a sectional view of a motorised valve of the control unit according to FIG. 14, for the control of the switching actuators.

DESCRIPTION OF THE PREFERRED EMBODIMENTS

Figure 1:
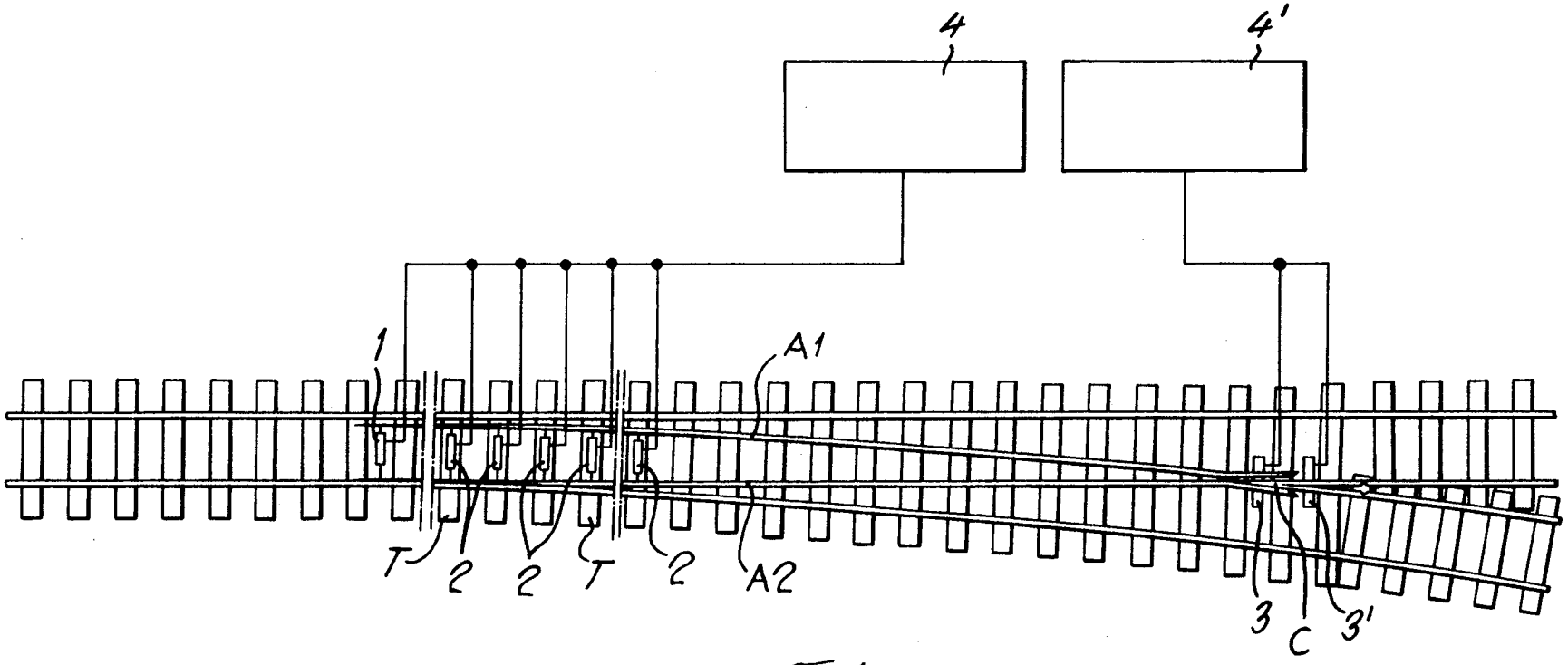
FIG. 1 is a schematic plan view of a railway switch for high-speed lines according to the invention.

FIG. 1 is a schematic illustration of a switch of the type used in high-speed railway lines. In this type of line, the switches have blades A1,A2 of considerable length (37 m approx.), with notably large radii of curvature. In FIG. 1 this is clearly shown by the fact that there are a number of breaks in the switch in the terminal area of the blade toes. For the movement of the switch from a closed position of one of the blades A1,A2 to the closed position of the opposite blade A2-,A1, a switching actuator 1 is provided near the toes of the blades A1,A2. Additionally, a plurality of intermediate switching actuators 2 are distributed along the length of the blades A1,A2 in the area between their toes and the switch frog C. For each closed position of the blades there is an associated position of the switch frog C, with which are associated a number of switching actuators 3,3'. The location of the individual switching actuators 2 along the blades A1,A2, and the location of the actuators 3,3' along the length of the switch frog C, are selected in such a way as to provide extremely rigid positioning in accordance with the correct geometry of the railway track. When a railway train passes, particularly at high speed, the blades A1,A2 and in particular the blade in the opened position A1,A2 cannot be subjected to displacement caused by the considerable stress exerted on them by the passing train.

The switching actuators 1,2 of the blades A1,A2 are of the hydraulic type and are controlled by a common control unit 4 which according to the following description is of the oil-hydraulic type. The switching actuators 3,3' are also of the hydraulic type and are controlled by a similar control unit 4'. The control units 4,4' are independent of each other but its is possible to provide manual means for the use of one of them as a reserve for the other.

As shown in FIG. 1, the intermediate actuators 2 are preferably fixed to the sleepers T between the blades A1,A2. This is to prevent a weakening of the packing of the sleepers which might lead to an amplification of the vibrations caused by the passage of the train in the rail and sleeper assembly.

The hydraulic or oil-hydraulic supply to the actuators, in addition to providing precise and sufficiently stable positioning of the blades A1,A2 along their whole length, advantageously ensures the retention of their natural flexibility during the operation of the switch. In fact, the movement of the blades A1,A2 is automatically matched to the increase or decrease in pressure due to the greater drag friction of the blades A1,A2.

With respect to the construction of the switching actuators 1 for the toes of the blades A1,A2, a switch lock device is used, as shown in FIGS. 2 to 6.

This switch lock device comprises two switch locks 5 and 6, each of which is associated with one of the blades A1,A2 of the switch. The two switch locks 5 and 6 are identical to each other and are located in positions which are mirror images of each other with respect to the track (FIGS. 3 to 6). They are preferably installed in the "sleeper space" between the first and second switch toe chairs.

Figure 2:
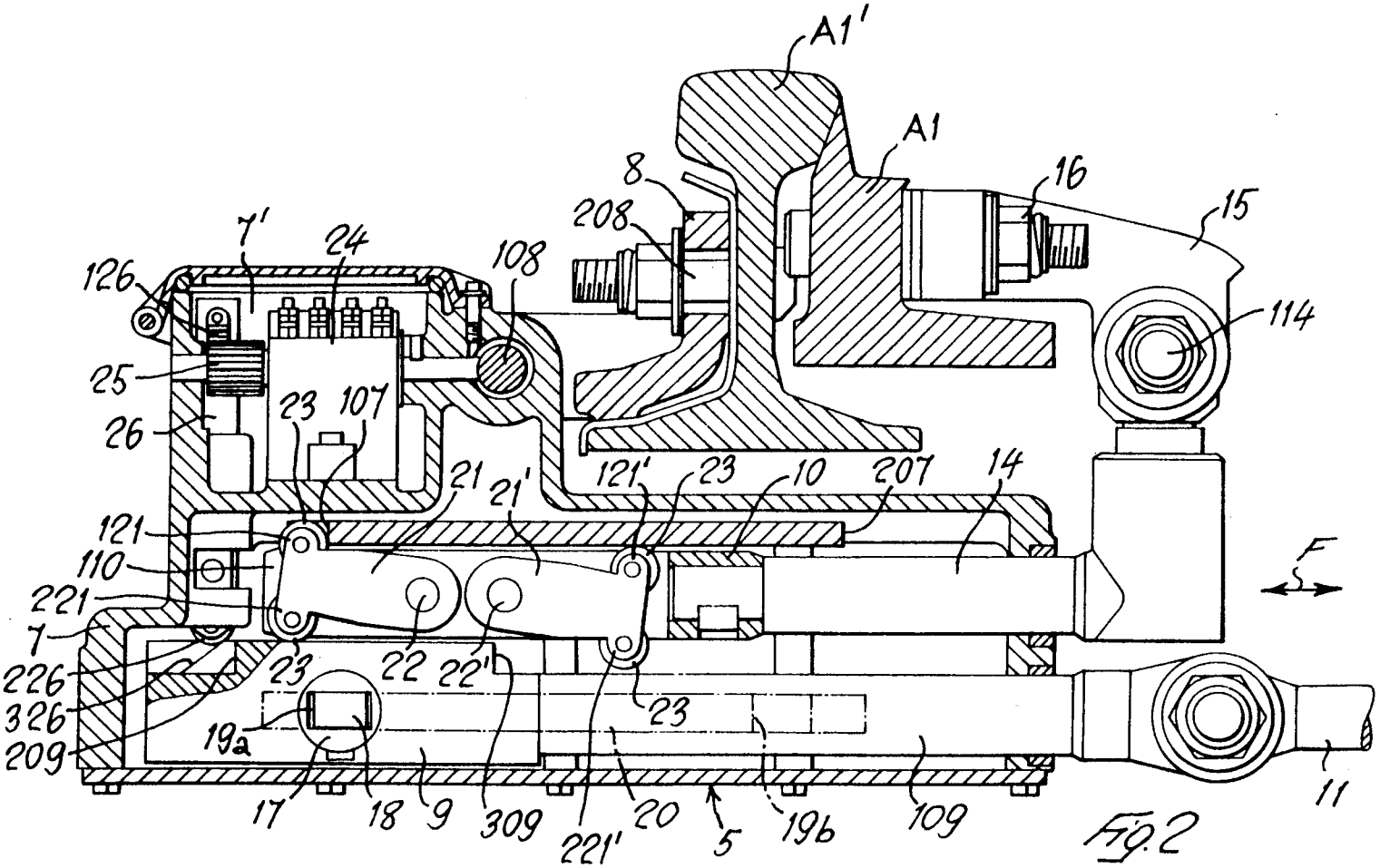
FIG. 2 is a section, in elevation, of a switching actuator for the toes of the blades.
Figure 3:
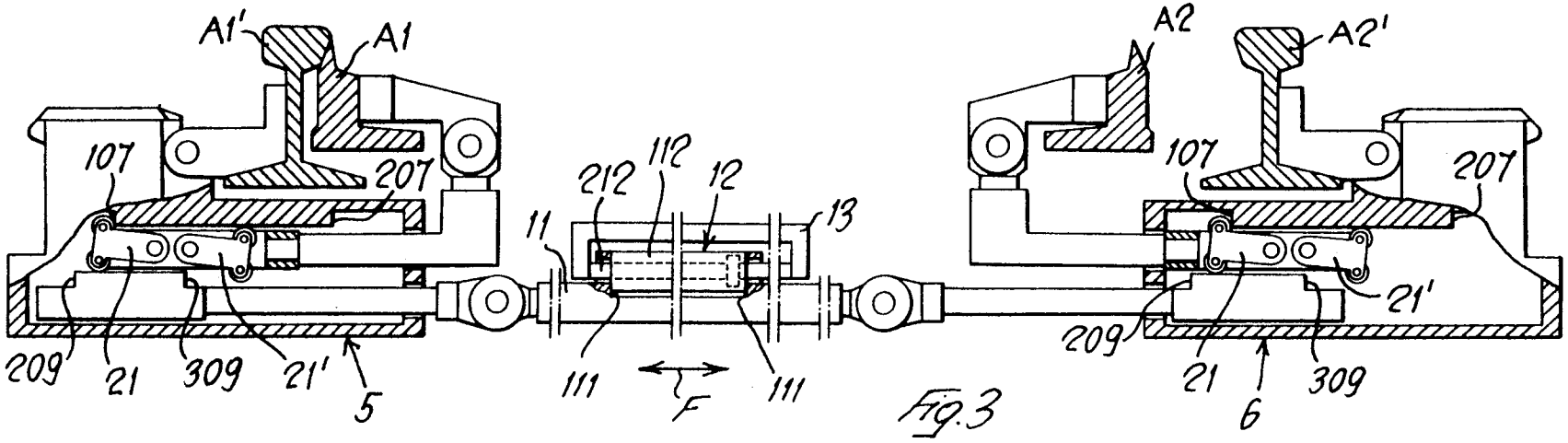
FIGS. 3 to 6 are sections of the switching actuator according to FIG. 2, in each of a number of successive stages of operation.
Figure 4:
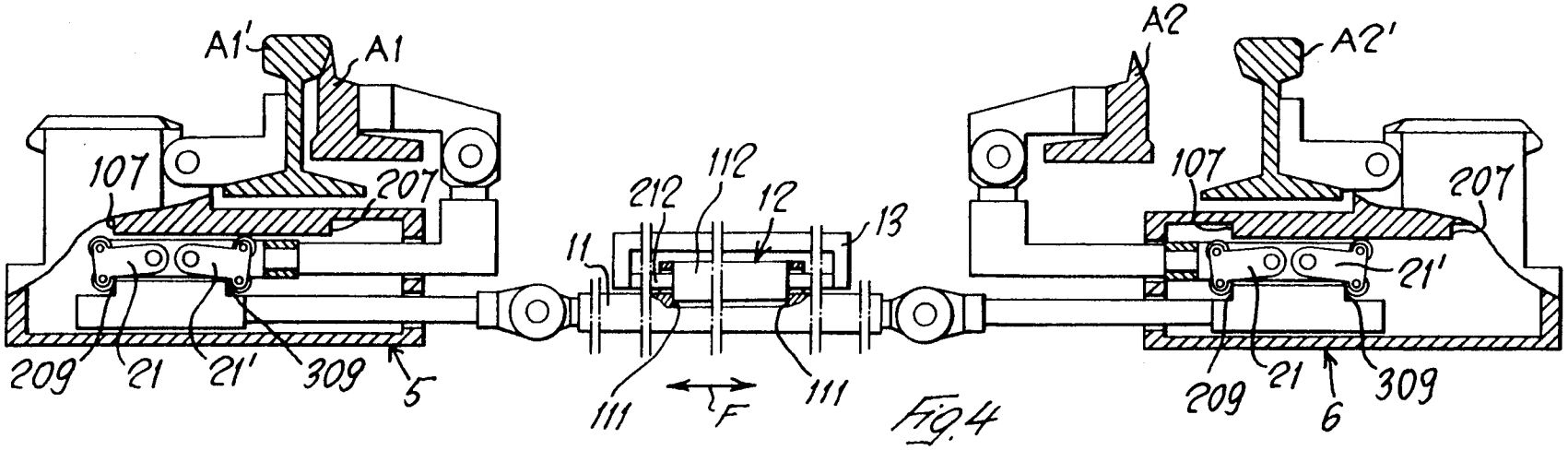

As shown in FIG. 2, which illustrates a single switch lock 5, each of the switch locks comprises a sealed casing 7 which is mounted under the respective stock rail A1',A2' and is fixed to the web of the rail by a bracket 8 and a bolt 208. The bracket 8 is fixed to the casing 7 by means of a pin 108. In the casing 7 of each switch lock 5,6, a lower slide 9, called the switching slide, and an upper slide 10, called the locking slide, are guided so that one is slidable over the other transversely with respect to the blades A1,A2. The lower switching slides 9 of the two switch locks 5,6 are interconnected by means of associated internal links and the connecting link 11. As shown in FIGS. 3 to 6, the connecting link 11 provided in the median area between the two blades A1,A2 is connected effectively to a hydraulic cylinder 12 with a fixed piston and moving cylinder. In particular, the hydraulic cylinder 12 is arranged with its piston rod 212 fixed at its ends between two opposite walls of a stationary box 13, while the body 112 of the cylinder 12 is slidable transversely with respect to the blades A1 and A2, and is held between two opposing shoulders 111 of the connecting link 11.

The upper slide, called the locking slide, 10, of each switch lock 5,6 is connected to the respective blade A1,A2 by means of a link 14 hinged at 114 to a bracket 15 which is fixed to the blade A1,A2 by means of bolts 16.

Between the switching slide 9 of each switch lock 5,6 and the respective casing 7 there is provided a trip lock device capable of locking the switching slide 9 to the casing 7 with a certain force of stabilisation in both end positions of the switch. The trip lock device preferably comprises two lateral locking rods 17, mounted so that they are slidable transversely with respect to the switching slide 9 in a corresponding housing in this slide, and both impelled outwards by an interposed pressure spring. Each locking rod 17 carries on its external end a roller 18 with a vertical axis, which emerges from the corresponding side of the switching slide 9. In each of the two end positions of the switching slide 9, the rollers 18 of the two locking rods 17 are engaged in corresponding indentations 19*a*,19*b* provided in lateral guide bars 20 which are integral with the casing 7.

The two switching slides 9 and locking slides 10 of each switch lock 5,6 are effectively interconnected by a device for coupling and locking (switch locking) in the closed position of each blade A1,A2. This device comprises two catch units 21,21', which are housed between the two arms 110 of the locking slide 10 which is constructed in the form of a fork.

Each catch unit 21,21' couples the switching slide 9 to the locking slide 10 of each switch lock 5,6 for the operation of bringing a blade A1,A2 into contact with its respective stock rail A1',A2' and locks the locking slide 10 of each switch lock 5,6 in the said position of contact to prevent any movement in the opposite direction not caused by the actuation of the switching slides 9.

The ends of the stems of the catch units 21,21' are pivoted at adjacent points 22,22' in such a way that they can oscillate freely, and they extend in opposite directions parallel to the locking slide 10. At their free ends, they have transversely widened heads forming upper catches 121,121' and lower catches 221,221'. Each catch 121,121', 221,221' has a roller 23 rotatable in the direction of sliding of the locking slide 10. The upper catch 121 and the lower catch 221 of the catch unit 21 engage with a step 107 of the casing 7 and a step 209 of the switching slide 9 respectively, arranged facing the said catches 121,221. Similarly, the upper catch 121' and the lower catch 221' of the catch unit 21' engage with steps 207 of the casing 7 and 309 of the switching slide 9 respectively, the said steps 207 and 309 being presented to the said catches 121' and 221' and facing in the opposite direction to steps 107,209 which engage with the other catch unit 21. The steps 107,207 of the casing 7 and the steps 209,309 of the switching slide 9 are interconnected by a flat surface which forms a slide way for the rollers 23 of the catch units 21,21'. Each catch unit 21,21' can therefore assume a downward directed angular position in which the locking slide 10 is coupled to the switching slide 9, for one of the two directions of sliding of the slides, by engaging with the lower catch 121,121' behind the respective step 209,309 of the switching slide 9. During the movement in one of the two directions indicated by the double-pointed arrow F, the respective catch unit 21,21' is held securely in its position of engagement with the step 209,309 by means of the opposite flat surface between steps 107,207 of the casing 7. On the other hand, the catch units 21,21' may assume an upward directed angular position for locking the locking slide, to prevent any displacement from the end position of the switch not caused directly by the movement of the switching slide 9. In this angular locking position, the upper catch 121,121' of the respective catch unit 21,21' engages with the associated step 107,207 of the casing 7, being retained in this position by the lower flat surface connecting the two steps 209,309 of the locking slide 9.

Figure 5:
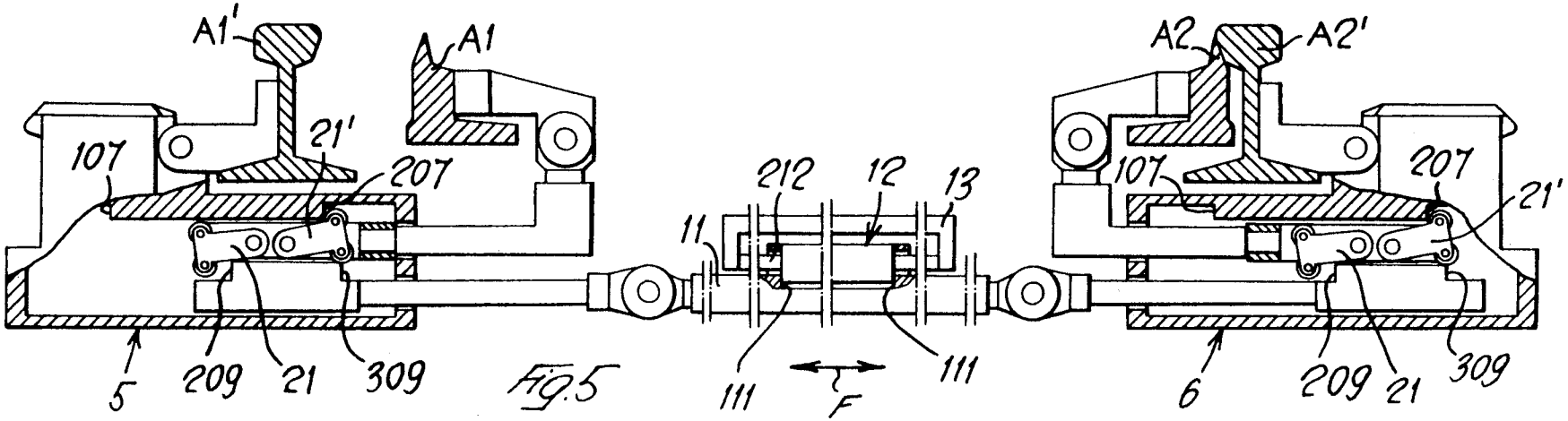
Figure 6:
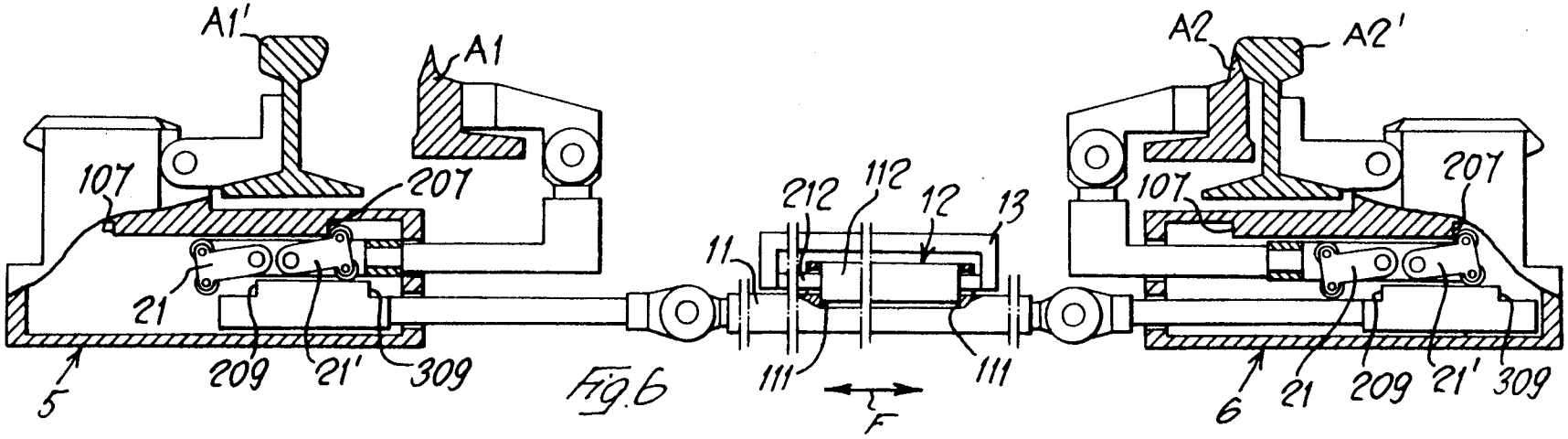
Figure 7:
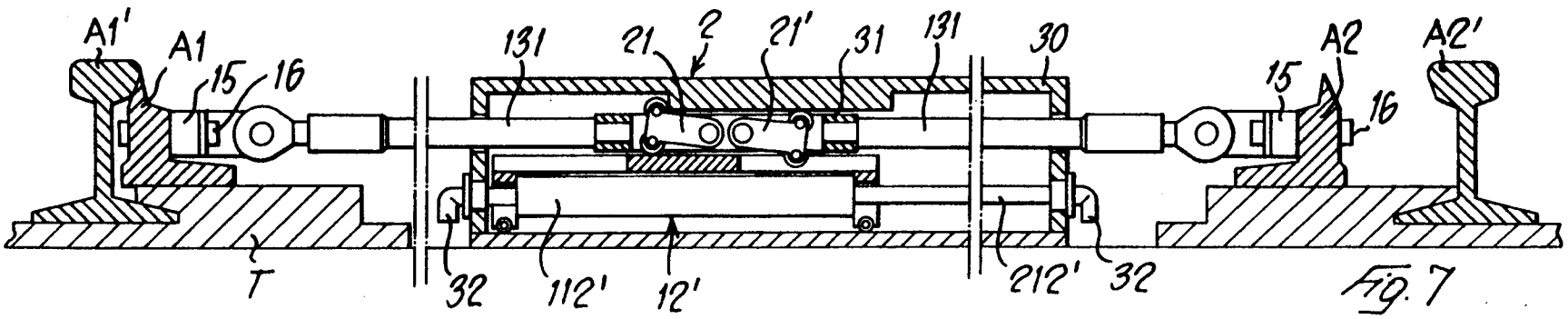
FIGS. 7 to 11 are sectional views of an intermediate switching actuator for the blades.
Figure 8:
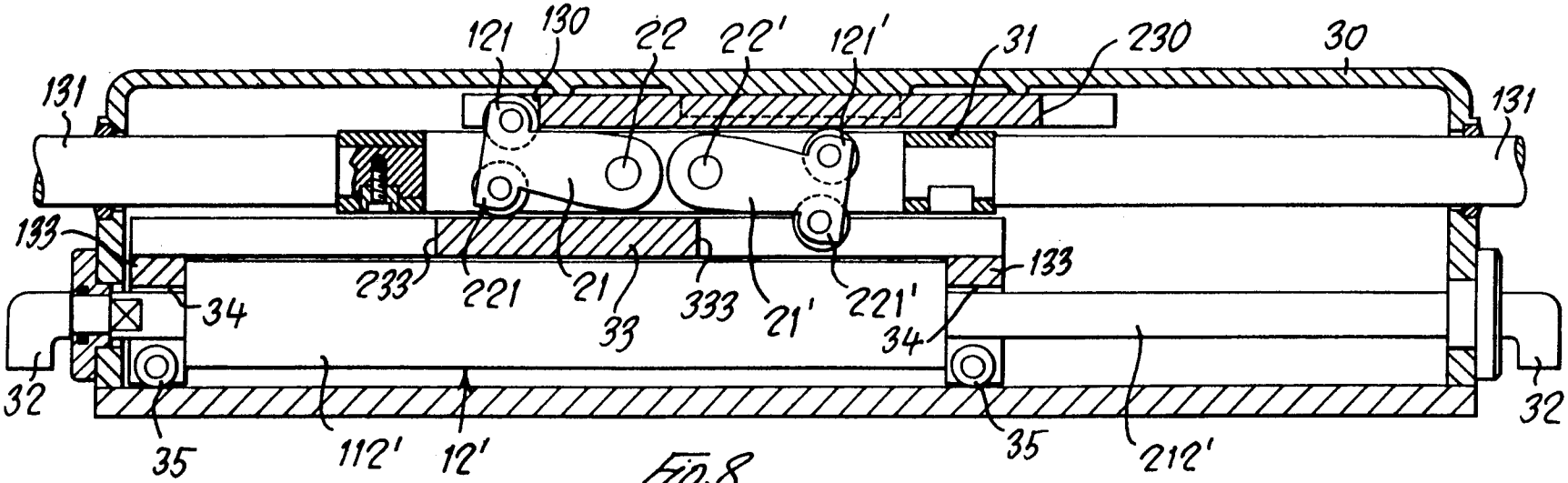
Figure 9:
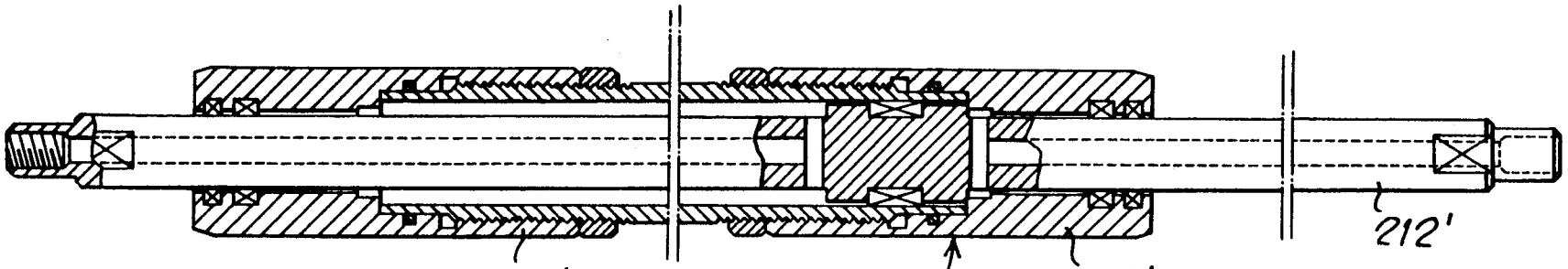

The operation of the device for coupling and locking the locking slides 10 is illustrated in greater detail in FIGS. 3 to 6, with reference to FIG. 2. In the position in which the blade A1 is in contact with the stock rail A1', according to FIG. 3, the catch units 21 of the two switch locks 5,6 are pushed into the upward angular position by the surface between the two steps 209,309 of the switching slide 9, and their upper catches 121 engage with the steps 107 of the casing 7, thus locking the locking slide 10 to prevent displacement in the direction of contact of the blade A2 with the stock rail A2'. The catch unit 21' is displaced angularly downwards, and therefore when the switching slide 9 is displaced in the direction of contact of the blade A2 with the stock rail A2', as in FIG. 4, the step 309 of the switching slide 9, facing this direction of displacement, is engaged with its lower catch 221', causing the locking slide 10 to be coupled in this direction to the switching slide 9. This takes place after a brief initial release travel, as a result of which the step 209 of the switching slide 9 is brought into alignment with the lower catch 221 of the catch unit 21, causing the downward angular displacement of the latter and therefore the disengagement of its upper catch 121 from the step 107 of the casing 7, with the consequent release of the locking slide 10 in the said direction of contact of the blade A2 with the stock rail A2'. As shown in FIGS. 5 and 6, when the end position of contact of the blade A2 with the stock rail A2' is reached, the switching slide 9 departs from the catch unit 21, while as a result of a brief subsequent travel it pushes the catch unit 21' into an upward angular position, in which its upper catch 121' is engaged behind the associated step 207 of the casing 7, being retained in this position by the flat connecting surface between the two catches 209,309 of the switching slide 9. This causes the locking slide 10 to be locked in the position of contact of the blade A2 with the stock rail A2', opposing any displacement in the direction of contact of the blade A1 with the stock rail A1' independent of the operation of the switching slide 9.

Each switch lock 5,6 is also provided with an electrical unit 24 which monitors the state of positioning of the switch. The said unit 24 is housed in a sealed compartment 7' of the casing 7 and is sealed by a top cover. The electrical monitoring unit 24 has a pinion 25 which is driven by two vertical tappets 26, only one of which is illustrated in FIG. 2. At their upper ends the two tappets 26 have racks 126 with which they engage with the pinion 25 on diametrically opposite sides. The lower end of each tappet 26 carries a roller 226 which bears on a corresponding inclined control surface 326 provided on top of the switching slide 9. The two control surfaces 326, only one of which is visible in FIG. 2, have two inclinations which are equal but in opposite directions, so that the pinion 25 is controlled simultaneously by both tappets 26.

An embodiment of the intermediate switching actuators 2 of the blades A1,A2 is illustrated in detail in FIGS. 7 to 11.

Unlike the switching actuators 1 of the toes of the blades A1,A2, the intermediate switching actuators 2 are located directly on an associated sleeper T. Each intermediate switching actuator 2 comprises a single switch lock and must be constructed in such a way as to be of minimum height. In a casing 30 which is integral with the sleeper T there is housed a slide 31 which is slidable transversely with respect to blades A1,A2, each of the ends of this slide being connected to a connecting link 131, whose free end is hinged to a bracket 15 fixed by bolts 16 to the respective blade A1,A2. In the casing 30, below the slide 31, there is a double-acting cylinder 12' which also has a fixed piston and a cylinder which is movable, in particular transversely with respect to the blades A1,A2. The piston rod 212' of the cylinder 12' is fixed at its ends to the end walls of the stationary casing 30. The piston rod 212' is constructed in tubular form and the pressure fluid is supplied through it, each of its two ends fixed to the casing 30 being connected with a sealed joint to a supply union 32 external to the casing 30. The body 112' of the hydraulic cylinder preferably comprises two end parts each of which may be screwed on to one end of a central cylindrical tube (see FIG. 9). The body 112' of the hydraulic cylinder 12' is fixed between the two end walls 133 of a carriage 33, the said end walls 133 being provided with a through hole 34 for the piston rod 212' of the cylinder 12'. The carriage 33 is installed slidably by means of rollers 35 in the box 30 under the slide 31.

The coupling between the carriage 33 or the cylinder 12' and the slide 31 is created similarly to the coupling between the locking slide 10 and the switching slide 9 of the switch lock 5,6 according to FIG. 2, by means of a device for coupling and locking the slide to prevent a switching displacement not directly controlled by the cylinder 12'. The said device is substantially similar to that of the switch lock according to FIG. 2, and the same reference numbers will be used in the description for identical parts or those having identical functions. The slide 31 carries two catch units 21,21', constructed in a way identical to those in FIG. 2, in such a way that they can oscillate about a horizontal axis which is transverse with respect to its direction of sliding. The upper catches 121,121' and the lower catches 221,221' of the two catch units 21,21' are intended to engage with the associated steps 130,230 of the casing 30 and 233,333 of the upper side of the carriage 33. In particular, steps 233 and 333 are formed by the ends of a section of wall separating two longitudinal slots in the carriage 33 each of which extends from one end of the carriage 33 in relation to which they are open as far as the respective ends 233 and 333 of the intermediate wall separating them. The operation of the device for coupling and locking the slide 31 (switch locking) is similar to the operation of the same device provided in switch locks 5,6 according to FIGS. 2 to 6, and is therefore not described in detail.

Figure 11:
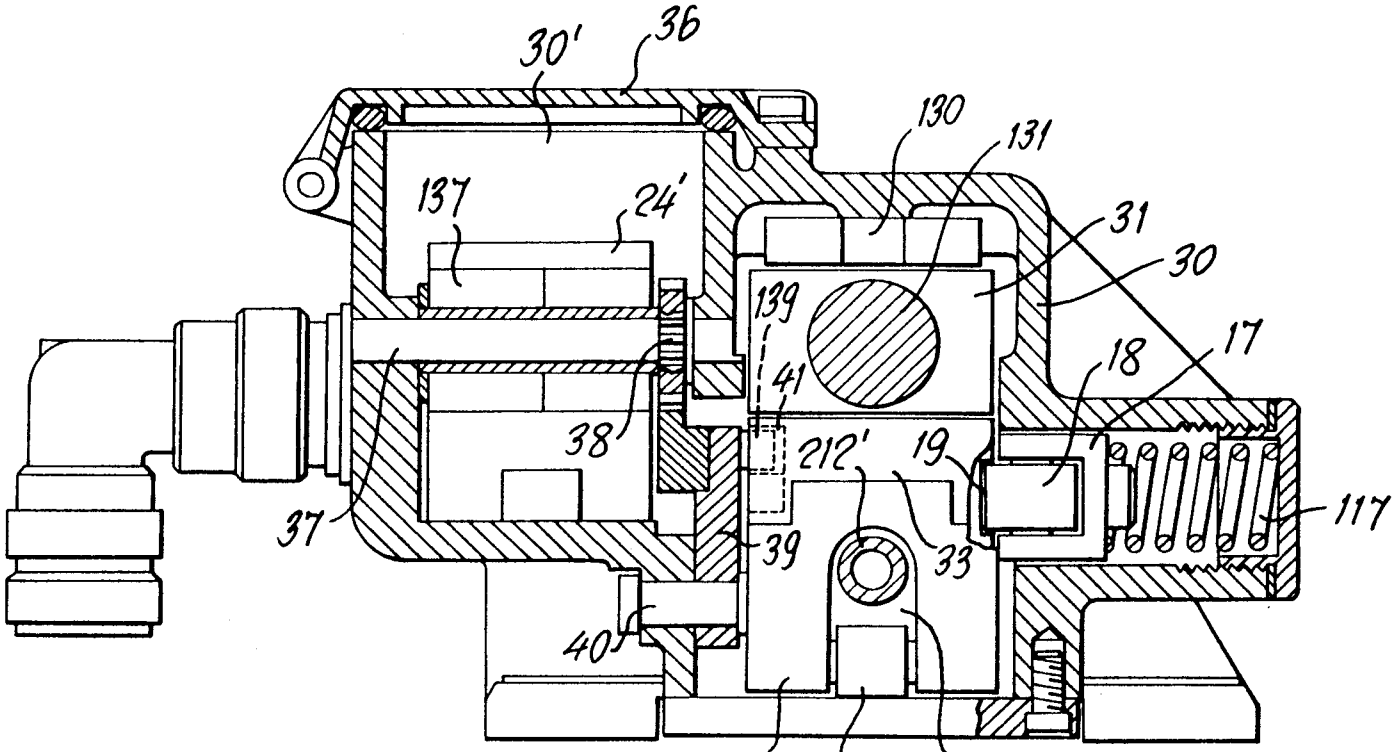

In the same way as switch locks 5,6 according to FIGS. 2 to 6, each intermediate switching actuator (FIG. 1) has a device for trip locking in the end positions of the switch operation (FIG. 11). This device may also be constructed in a way substantially identical to that shown in FIG. 2, comprising a lateral locking rod 17 mounted so that it is slidable transversely with respect to the carriage 33 in a housing in the casing 30, the said rod 17 being provided, on its free end, with a roller 18 with a vertical axis, and being impelled towards the carriage 33 by an interposed spring 117. The locking rod 17 engages with corresponding indentations 19 provided in the associated side of the carriage 33.

Figure 10:
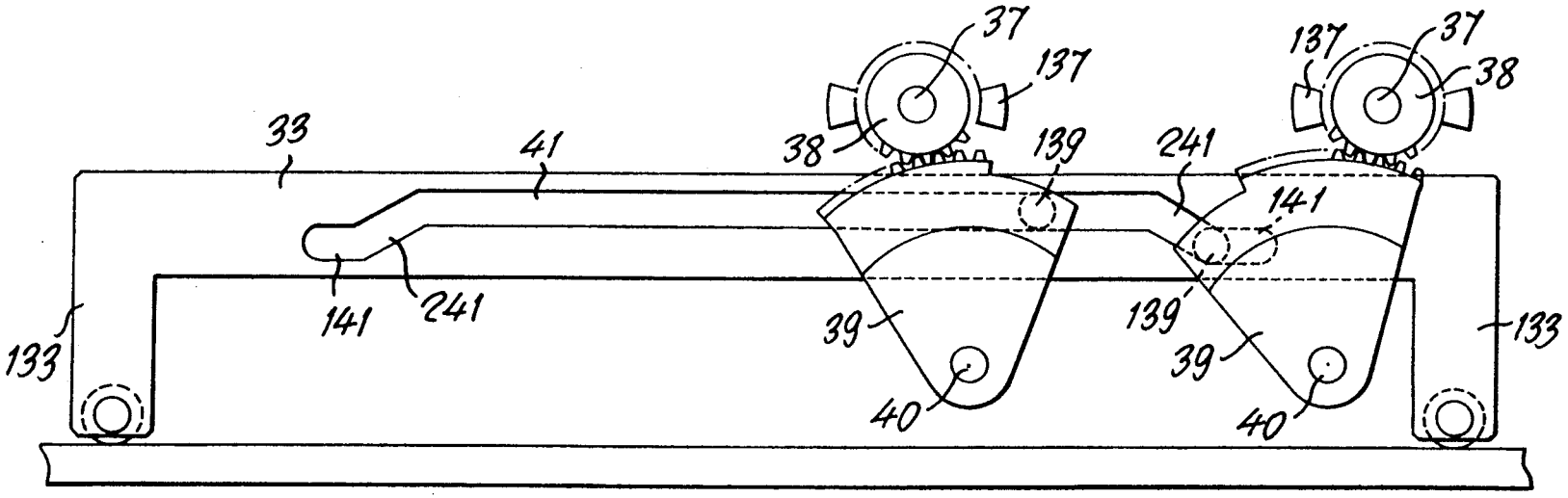

To indicate the condition of the actuator, with reference to the end position of the switch and according to FIGS. 10 and 11, the intermediate switching actuators 2 are also each provided with an electrical monitoring unit 24' for each blade A1,A2. The units 24' are housed side by side in a sealed compartment 30' of the casing 30 which is closed at the top by a cover 36 and is located adjacent to a longitudinal side of the casing 30. Each monitoring unit 24' is controlled by a horizontal shaft 37 which is perpendicular to the direction of sliding of the carriage 33. Each shaft 37 is provided with radial teeth 137 which are distributed suitably along its length, for the control of electrical contacts. On their ends facing the carriage 33, they are provided with a gear wheel 38 which engages with the upper peripheral toothed edge of a toothed circular sector 39. Each toothed sector 39 is pivoted at its lower vertex at 40 on the side of the casing 30 so that it can oscillate in the direction of sliding of the carriage 33, engaging with a pin 139 in a grooved cam 41 provided in the associated side of the carriage 33. The cam 41 has a substantially horizontal form and terminates at its two opposite ends with a section at a lower level 141, to which it is connected by a downward sloping intermediate section 241. This causes the alternate oscillation of one of the circular toothed sectors 39 at each end position of the switch, with consequent switching of the signals provided by the respective electrical monitoring unit 24'.

The switching actuators 3,3' for the switch frog C are made identical to each other and in the present embodiment (FIG. 1) are also located, like the actuator, 1, of the toes of the blades A1,A2, in the sleeper space. In a similar way to the previous embodiments according to FIGS. 2 to 11 of the switching actuators 1,2 for the blades A1,A2, the switching actuators 3,3' for the switch frog C have a hydraulic operating cylinder, a device for coupling and locking the organs for transmission of the switching motion to the frog C, a trip locking device for the end positions of the switch, and electrical monitoring units.

With reference to FIGS. 12 and 13, the construction of the switching actuator 3,3' for the switch frog C is also substantially similar to that of the switching actuators 1,2 for the blades A1,A2. Each switching actuator 3,3' for the frog C has two switch locks, 5',6'. Each switch lock 5',6' comprises a sealed casing 50 within which are housed the switching slide 9' and the locking slide 10'. The locking slide 10' of each switch lock 5',6' is connected by means of a link 110' to a common intermediate connecting block 52 which carries a pair of jaws 53 gripping the frog C, in such a way that they can rotate about a vertical axis. The jaws 53 gripping the frog C are hinged together at 54 under the frog and are secured to the frog C by means of bolts or similar, 55. The switching slides 9' are connected directly to the ends of the piston rod 212" of a hydraulic cylinder 12" of the double-acting type with a fixed cylinder and moving piston. The body of the hydraulic cylinder 12" is kept stationary between the two facing end walls of the switch locks 5',6' which are provided with suitable holes, 56.

Each switch lock 5',6' has a single catch unit, 21 and 21' respectively, which causes the two slides 9',10' to be coupled only in one of the two directions of movement of the switch. Each catch unit 21,21' is constructed in an identical way to those described previously and is pivoted on the locking slide 10' so that it can oscillate in a horizontal, instead of vertical, plane. The steps in which the two opposite catches 121,121' and 221,221' of the catch units 21,21' engage are formed on one side by the two opposite ends 107,207 of a block 57 supported adjustably with respect to its position in the direction of sliding of the slides, and on the other side by the end surfaces 209',309' of the respective switching slide 9'. The block 57 has, for example, a threaded through hole oriented in the direction of sliding of the slides 9',10', in which is engaged a screw 58 supported rotatably in the external end wall of the casing 50 of the respective switch lock 5',6'. The operation of the catch units for the coupling of the locking slide 10' to the switching slide 9' is substantially identical to that described previously with reference to the previous figures. The device for the trip locking of the switching slide 9' in the end positions of the switch is differentiated in that each switch lock 5',6' has a single locking rod 17" mounted so that it is slidable vertically downwards in the corresponding switching slide 9'. Similarly to the previous switching actuators 1,2, the rod is impelled outwards by an interposed spring 117" and carries a roller 18" at its free end. The rod engages with locking indentations 19*a*" and 19*b*" provided in a longitudinal bar 20" integral with the base of the box 50.

Each switch lock 5',6' of the switching actuator 3,3' of the switch frog C has an electrical monitoring device 24" housed in a sealed compartment 50' of the casing 50. The electrical monitoring device 24" is constructed substantially in accordance with the embodiment according to FIG. 2, and has a control pinion 25" with which two racks 126", carried by vertically displaceable tappets 26", engage on two diametrically opposite sides. The movement of the racks is controlled by tracks 326" inclined in opposite directions which are provided on the upper longitudinal side of the switching slide 9' and on which the tappets 26" run by means of rollers 226".

An embodiment of the control units 4,4' for the switching actuators 1,2 of the blades A1,A2 and for actuators 3,3' of the frog C is illustrated in FIG. 14. The switching actuators 1,2,3,3' are preferably of the oil-hydraulic type. Each control unit has a reservoir 60 for the oil in which is immersed the intake line of a pump 61 which is operated by a motor 62, preferably electric. The pump 61 is connected by a supply line 66 with a non-return valve 65 interposed and a cock 63 to a pressurised oil accumulator 64. The control unit may be provided with a number of pressure accumulators and this is shown by the additional pressure accumulator 64' illustrated in broken lines in FIG. 14. An external discharge line 67 with a discharge cock 167 and a line 68 for discharge into the reservoir 60, provided with a discharge cock 168, are branched from the supply line 66 between the non-return valve 65 and the cocks 63 of the accumulators 64,64'. A connecting line 69 to the switching actuators 1,2,3 is also connected to the same supply line 66. A pressure-operated switch 70 for a maximum pressure value, a pressure-operated switch 71 for a minimum pressure value, a motorised valve 72, a flow regulator 73, and an electromagnetic valve 74 are interposed in the connecting line 69 to the switching actuators 1,2,3. The electromagnetic valve 74 is of the four-way, three-position type. To this is also connected a return line 77 to the oil reservoir 60 which is suitably provided with a filter 177, while the delivery end of the pump 61 is connected to the return line 77 through a safety valve 78. The electromagnetic valve 74 is connected through quick-connect couplers 75,75' to the delivery and return lines 76,76' of the double-acting oil-hydraulic cylinders of the switching actuators. In addition, in order to carry out the movement of the switch both in one direction and in the opposite direction, i.e. to perform the so-called normal and reverse movement of the switch, the electromagnetic valve 74 is provided with two separate coils 174.

The supply to the motor or motors 62 of the pump or pumps 61 is preferably provided through a no-break power unit which provides power during any interval between failure of a primary power and the time that an auxiliary power can be made available. The motors are preferably all connected in parallel and are designed to automatically maintain the pressure in the accumulators 64,64', in particular with the aid of the maximum and minimum pressure-operated switches 70,71. The supply circuit of the motor or motors 62 may also be provided with a probe to measure the oil level in the reservoir 60, connected in such a way that the pumps are cut off when there is insufficient oil in the reservoir, thus protecting the circuit from a damaging entry of air. Additionally, the minimum pressure-operated switch 71 enables the start of a movement of the switch to be prevented directly at the switch or by remote control, when the pressure in the accumulators 64,64' is not sufficient to guarantee the complete execution of the movement, and preferably when the pressure is not sufficient to guarantee the so-called test movement, i.e. the movement of the switch and the corresponding return movement to the initial position.

For this purpose, the motorised valve 72, which controls the opening and closing of the connecting line 69 to the switching actuators, is provided in the connecting circuit 69 between the accumulators 64,64' and the actuators. This valve is preferably provided with an electrical unit monitoring its state, by means of which it is possible to determine its switching position remotely.

FIG. 15 shows a preferred embodiment of the motorised valve 72. The body 80 of the valve 72 houses a spherical obturator 81 which is free to rotate, its control shaft 82 being connected in a non-reciprocally rotatable way to a coaxial control shaft 83 of the electrical monitoring unit 84 by means of an intermediate external section 85 on which is fixed a pinion 86. The pinion 86 engages with a rack 187 controlled by an actuating unit 87 which causes its transverse displacement with respect to shafts 82 and 83 and their consequent rotation. The displacement of the rack 187 may be produced by any type of linear actuating system, such as a relay or similar. It is also possible to provide a stable rest position of the rack produced by suitable elastic means of return to the said position.

We claim:

1. An operating device for a railway switch, the railway switch including first and second main rails, a frog, and first and second blades associated respectively with the first and second main rails, with each blade having a toe at one end, an intermediate portion, and a heel end at the other end, said operating device comprising:

a hydraulic blade actuator means for switching the blades at the toes between a first position where the toe of the first blade is immediately adjacent the first main rail and the toe of the second blade is spaced from the second main rail and a second position where the toe of the first blade is spaced from the first main rail and the toe of the second blade is immediately adjacent the second main rail;

a hydraulic frog actuator means for switching the frog between a first position where the frog is immediately adjacent the heel end of the first blade and spaced from the heel end of the second blade and a second position where the frog is immediately adjacent the heel end of the second blade and spaced from the heel end of the first blade;

a hydraulic intermediate actuator means located between said blade actuator means and said frog actuator means for switching the intermediate portions of said blades between first and second positions which are consistent with the first and second positions of the toes of the blades; and a controlling means for controlling the hydraulic switching actions of said blade actuator means, said frog actuator means and said intermediate actuator means, said controlling means including a fluid reservoir containing a fluid, a pressure accumulator in which the fluid is accumulated under pressure, and a pump means for pumping the fluid from said reservoir to said accumulator under pressure, said pump means including an electric motor and a no-break power unit for said electric motor.

2. An operating device for a railway switch as claimed in claim 1 wherein said frong actuator means includes at least two hydraulic actuator mechanisms which are spaced from one another and which move associated portions of the frog as a unit.

3. An operating device for a railway switch as claimed in claim 1 wherein the main rails are provided on sleepers, and wherein said intermediate actuator means is secured to one of the sleepers.

4. An operating device for a railway switch as claimed in claim 1 wherein said control means includes a first control unit for said blade actuator means having a first pressure accumulator, a second control unit for said frog actuator means having a second pressure accumulator, and a means for connecting said first and second pressure accumulators so that said first and second pressure accumulators are selectively capable of supplying pressurized fluid to the respective other said second and first control units.

5. An operating device for a railway switch as claimed in claim 1 wherein said blade actuator means and said frog actuator means each include an actuating motor and an electrical monitoring device for monitoring the position of the associated blade or frog, said electrical monitoring device including a slidable member having two cam surfaces which is connected to said actuating motor and which moves with the associated blade or frog, a pinion mounted on a fixed shaft, opposed racks which engage said pinion on opposite sides thereof and which have a tappet at one end which said tappets engage a respective cam surface of said slidable member.

6. An operating device for a railway switch as claimed in claim 1 wherein there is a minimum pressure needed in said pressure accumulator to power said blade actuator means, said frog actuator means and said intermediate actuator means between the associated first positions and second positions of the blades or frog and back again; and wherein said controlling means further includes a main supply line from said pressure accumulator to said actuator means, and a preventing means for preventing actuation of said actuator means when the pressure in said pressure accumulator or said main supply line is less than the minimum pressure.

7. An operating device for a railway switch as claimed in claim 6 wherein said controlling means further includes a safety means for stopping said pump means if there is an insufficient fluid level of the fluid in said fluid reservoir, and a switch means for automatically actuating said pump means when the pressure in said main supply line is below the minimum pressure and for automatically deactivating said pump means when the pressure in said main supply line is above a predetermined maximum pressure.

8. An operating device for a railway switch as claimed in claim 7 wherein said switch means includes a first pressure operated switch which detects the minimum pressure in said main supply line and a second pressure operated switch which detects the maximum pressure in said main supply line; and wherein said preventing means includes a motorized valve means in said main supply line which is closed when said first pressure operated switch detects the minimum pressure in said main supply line.

9. An operating device for a railway switch as claimed in claim 8 wherein said actuator means each include a double-acting oil-hydraulic cylinder having a delivery line and a return line; wherein said controlling means further includes a four-way, three position electromagnetic valve to which said main supply line and said delivery and return lines are connected, said electromagnetic valve having two separate coils for actuation; and further including a reservoir return line with a filter therein extending from said electromagnetic valve to said reservoir.

10. An operating device for a railway switch as claimed in claim 8 wherein said motorized valve includes an electrical unit for monitoring an open or shut position of said motorized valve.

11. An operating device for a railway switch as claimed in claim 10 wherein said motorized valve further includes a spherical obturator, a control shaft for said obturator, a control shaft for said electrical unit which is coaxially connected to said control shaft of said obturator, a pinion provided coaxially of said control shafts, a rack which engages said pinion, and a motor which moves said rack to cause said obturator to change positions and to cause said electrical unit to monitor the position of said obturator.

12. An operating device for a railway switch as claimed in claim 1 wherein each of said actuator means includes: an actuating motor; and a switch lock mechanism including (a) a trip locking means for locking the associated said actuating motor in first and second positions associated with said first and second positions of the associated said blade or frog, (b) a coupling means for coupling the associated said blade or frog to said actuating motor and for locking the associated said blade or frog in said first and second positions against movement therefrom not caused by said actuating motor, and (c) an electrical monitoring means for monitoring the position of the associated said blade or frog.

13. An operating device for a railway switch as claimed in claim 12 wherein said switch lock mechanism includes a stationary casing having indentations therein; and wherein said trip locking means includes a switching slide connected to said actuating motor, locking rods extending in opposite directions from said switching slide, an elastic means for urging said locking rods away from said switching slide, and a respective roller at a distal end of said locking rods which roll along said casing and into said indentations to lock the actuating motor in the first and second positions thereof.

14. An operating device for a railway switch as claimed in claim 12 wherein said intermediate actuator means includes a single trip locking means for an associated said actuating motor which said trip locking device is located between the first and second blades.

15. An operating device for a railway switch as claimed in claim 12 wherein said actuating motor of said frog actuator means includes a fixed hydraulic cylinder and a movable piston; and wherein each said switch lock mechanism of said frog actuator means includes a stationary casing having a fixed catch therein, a switching slide connected to said movable piston and movable thereby parallel to the movement of the frog, a locking slide having a catch step in said switch casing, a link hingedly connecting said locking slide to the frog, and a catch unit mounted to said locking slide for oscillation about an axis perpendicular to a moving axis of said locking slide which is engagable with said catch step to move said locking slide in one direction together with said switching slide by said actuating motor and which is then engaged with said fixed catch when said actuating motor stops moving said switching slide.

16. An operating device for a railway switch as claimed in claim 12 wherein there are two of said switch lock mechanisms with a respective said trip locking means for each said actuating motor of said blade actuator means and of said frog actuator means, said switch lock mechanisms being located on respective sides of the respective said actuating motor.

17. An operating device for a railway switch as claimed in claim 16 wherein said actuating motor of said blade actuator means includes a movable hydraulic cylinder and a fixed piston; and wherein each said switch lock mechanism of said blade actuator means is associated with a respective blade and includes a stationary casing having fixed catches therein, a switching slide connected to said movable hydraulic cylinder and movable thereby transverse to a longitudinal axis of the associated blade in said switch casing, a locking slide having opposed catch steps in said switch casing, a link hingedly connecting said locking slide to the associated blade, and two opposed catch units mounted to said locking slide for oscillation about an axis perpendicular to a moving axis of said locking slide which are alternately engagable with an associated said catch step to move said locking slide together with said switching slide by said actuating motor and which are alternately engaged with a respective said fixed catch when said actuating motor is not moving said switching slide.

18. An operating device for a railway switch as claimed in claim 17 wherein said catch units are substantially T-shaped to form a central arm and a cross bar, said catch units being mounted to said locking slide at a free end of said arm and said cross bar having opposed ends with rollers attached thereto which respectively engage an associated one of said catch step or said fixed catch.

19. An operating device for a railway switch as claimed in claim 12 wherein said actuating motor of said intermediate actuator means includes a movable hydraulic cylinder and a fixed piston; and wherein said switch lock mechanism of said intermediate actuator means includes a stationary casing having fixed catches therein, a switching slide connected to said movable hydraulic cylinder and movable thereby parallel to a longitudinal axis of said hydraulic cylinder, a locking slide having opposed catch steps in said switch casing, two links hingedly connecting opposite ends of said locking slide to adjacent blades, and two opposed catch units mounted to said locking slide for oscillation about an axis perpendicular to a moving axis of said locking slide which are alternately engagable with an associated said catch step to move said locking slide together with said switching slide by said actuating motor and which are alternately engaged with a respective said fixed catch when said actuating motor is not moving said switching slide.

20. An operating device for a railway switch as claimed in claim 19 wherein said switching slide includes opposed ends which trap said movable cylinder therebetween and which are provided with central holes; and wherein said piston of said actuating motor includes opposed rods extending from opposite sides thereof through respective said holes of said switching slide and which are fixed to said stationary casing, said rods being hollow and being fluidly connected to said pressure accumulator.

21. An operating device for a railway switch as claimed in claim 20 where said switch lock mechanism includes a grooved cam in a side of said switching slide and two adjacent electrical monitoring units for monitoring the two positions of the blades, said monitoring units each including a pinion mounted for rotation about a fixed shaft, a toothed circular sector which engages said pinion, a hinge means for mounting said circular sector to said stationary casing for oscillatory motion parallel to a longitudinal axis of said movable cylinder, and a pin which extends from said circular sector and is engaged in said grooved cam such that alternate ones of said two monitoring units is actuated when said blades are in the first or second positions.

22. An operating device for a railway switch, the railway switch including first and second main rails, a frog, and first and second blades associated respectively with the first and second main rails, with each blade having a toe at one end, an intermediate portion, and a heel end at the other end, said operating device comprising:

a hydraulic blade actuator means for switching the blades at the toes between a first position where the toe of the first blade is immediately adjacent the first main rail and the toe of the second blade is spaced from the second main rail and a second position where the toe of the first blade is spaced from the first main rail and the toe of the second blade is immediately adjacent the second main rail, said blade actuator means including a hydraulic actuator mechanism which moves the toes of the blades as a unit;

a hydraulic frog actuator means for switching the frog between a first position where the frog is immediately adjacent the heel end of the first blade and spaced from the heel of the second blade and a second position where the frog is immediately adjacent the heel end of the second blade and spaced from the heel end of the first blade, said frog actuator means including at least two hydraulic actuator mechanisms which are spaced from one another and which move associated portion of the frog as a unit;

a hydraulic intermediate actuator means located between said blade actuator means and said frog actuator means for switching the intermediate portions of said blades between first and second positions which are consistent with the first and second positions of the blades, said intermediate actuator means including at least two hydraulic actuator mechanisms which are spaced from one another and which move associated intermediate portions of the blades as a unit; and a controlling means for controlling the hydraulic switching actions of said actuator mechanisms of said blade actuator means, of said frog actuator means, and of said intermediate actuator means;

wherein each of said actuator means further includes a switch lock mechanism including (a) a trip locking means for locking the associated said actuating mechanism in first and second positions associated with said first and second positions of the associated said blade or frog, (b) a coupling means for coupling the associated said blade or frog to said actuating mechanism and for locking the associated said blade or frog in said first and second positions against movement therefrom not caused by said actuating mechanism, (c) an electrical monitoring means for monitoring the position of the associated said blade or frog and (d) a stationary casing having indentations therein; and wherein said trip locking means includes a switching slide connected to said actuating mechanism, locking rods extending in opposite directions from said switching slide, an elastic means for urging said locking rods away from said switching slide, and a respective roller at a distal end of said locking rods which rolls along said casing and into said indentations to lock the actuating mechanism in the first and second positions thereof.

* * * * *